US005077947A

United States Patent [19]

Takeda

[11] Patent Number: 5,077,947

[45] Date of Patent: Jan. 7, 1992

[54] STONE PANEL MOUNTING APPARATUS

[75] Inventor: Akihiko Takeda, Tokyo, Japan

[73] Assignee: Yoshida Kogyo K.K., Tokyo, Japan

[21] Appl. No.: 594,696

[22] Filed: Oct. 9, 1990

[30] Foreign Application Priority Data

Oct. 24, 1989 [JP] Japan ..... 1-123550

[51] Int. Cl.[5] ..... E04F 13/08; E04B 2/90

[52] U.S. Cl. ..... 52/235; 52/778

[58] Field of Search ..... 52/235, 778

[56] References Cited

U.S. PATENT DOCUMENTS 3,715,848 2/1973 Jordan ..... 52/235
4,563,848 1/1986 Gartner ..... 52/235
4,979,344 12/1990 Kusunoki ..... 52/235

FOREIGN PATENT DOCUMENTS 53-125319 11/1978 Japan .
61-147825 9/1986 Japan .

*Primary Examiner*—John E. Murtagh

*Attorney, Agent, or Firm*—Hill, Van Santen, Steadman & Simpson

[57] ABSTRACT

The present invention relates to an apparatus for mounting stone panels comprising a rectangular support frame unit formed by upper and lower horizontal frames and left- and right-hand vertical frames both of which being respectively connected to the upper and the lower horizontal frames, a stone panel having a continuously extending notch formed along the outer peripheral edge of the rear surface thereof and mounted through the notch on the front surface of the support frame, and a rectangular mounting framework formed by upper and lower mounting frames fixedly secured through upper and lower connecting metal fixtures, respectively, onto a building body, and left- and right-hand vertical mounting frames both of which being respectively connected to the upper and the lower mounting frames. The upper and lower mounting frames are provided with upwardly extending receiving pieces formed integrally on their respective front portions so as to mount at least one support frame unit thereon.

5 Claims, 3 Drawing Sheets

STONE PANEL MOUNTING APPARATUS

BACKGROUND OF THE INVENTION

1. Field of the Invention

This invention relates to an apparatus or structure for mounting stone panels made of native rock or imitation stone or the like or a building body.

2. Description of the Prior Art

As prior art examples, there is known an apparatus disclosed in Japanese Patent Application Laid-Open Specification NO. SHO 53-125319 wherein prefabricated concrete boards fitted with sub-metal fixtures on the rear surface thereof are mounted on a building body fitted with main metal fixtures by connecting the sub-metal fixtures to the main metal fixtures, and another apparatus disclosed in Japanese Utility Model Application Laid-Open Specification NO. SHO 61-147825 wherein external boards fitted with metal fixtures having downward hook-shaped pieces on the rear surface thereof are mounted on a building body fitted with receiving metal fixtures having upward hook-shaped pieces by engaging the downward hook-shaped pieces with the upward hook-shaped pieces.

In the above-mentioned prior art panel mounting apparatus, since prefabricated concrete boards or external boards are directly mounted on a building body by means of metal fixtures, in case a plurality of prefabricated concrete boards or external boards are mounted on the building body, such boards have to be mounted on the building body one by one so that the mounting operation becomes very troublesome.

In particular, since stone panels are heavy and liable to be damaged, it is troublesome to handle them, and the operation of mounting stone panels on a building body one by one is very troublesome to workers.

SUMMARY OF THE INVENTION

The present invention has been made in view of the above-mentioned circumstances in the prior art, and has for its object to provide a stone panel mounting apparatus which facilitates mounting of stone panels on a building body and prevents rainwater from making ingress into the space between the stone panels and support frames thereof.

To achieve the above-mentioned object, according to a first aspect of the present invention, there is provided a stone panel mounting apparatus comprising: a rectangular support frame unit formed by an upper horizontal frame, a lower horizontal frame, and a left-hand vertical frame and a right-hand vertical frame, both of which are connected to the upper and lower horizontal frames, respectively; a stone panel having a continuously extending notch formed along the outer through the intermediary of the notch on the front surface of the support frame unit; and a rectangular mounting framework formed by an upper mounting frame fixedly secured through the intermediary upper connecting metal fixtures onto a building body and having an upward receiving piece formed on the front portion thereof, a lower mounting frame fixedly secured through the intermediary of lower connecting metal fixtures on the building body and having an upward receiving piece formed on the front portion thereof, and a left-hand vertical mounting frame and a right-hand vertical mounting frame, both of which are connected to the upper and lower mounting frames, respectively, and wherein at least one support frame unit having the stone panel fitted thereto is mounted on the outdoor side front surface of the mounting framework.

According to a second aspect of the present invention, there is provided a stone panel mounting apparatus as set forth in the first aspect, wherein the upper horizontal frame of the support frame unit comprises a rectangular, hollow body, a vertical plate formed as the front part of the body and extending upwardly, a hook-shaped piece having an L-shaped longitudinal section, the hook-shaped piece being formed integrally with the upper portion of the vertical plate so as to project therefrom further forwardly to thereby form an upward groove between the hook-shaped piece and the vertical plate, and a supporting piece having an inverted L-shaped longitudinal section with the leading end of the L shape facing downwardly, the supporting piece being located opposite to the hook-shaped piece relative to the vertical plate and formed integrally with the body so as to project rearwardly therefrom;

the lower horizontal frame of the support frame unit comprises a rectangular, hollow body, a vertical plate formed as the front part of the body and extending downwardly, a hook-shaped piece having an inverted L-shaped longitudinal section, the hook-shaped piece being formed integrally with the lower portion of the vertical plate so as to project therefrom further forwardly to thereby form a downward groove between the hook-shaped piece and the vertical plate, and a supporting piece having a crank-shaped longitudinal section with the leading end of the crank-shape extending horizontally, the supporting piece being located rearwardly of the body and formed integrally with the body so as to project rearwardly therefrom; and each of the left-hand and right-hand vertical frames of the support frame unit comprises a rectangular, hollow body, and an inward and lateral hook-shaped piece having an L-shaped or inverted L-shaped cross-section, the hook-shaped piece being formed integrally with the body so as to project from the left-hand end or the right-hand end thereof to thereby form a transverse groove between the hook-shaped piece and the front portion of the body;

wherein the supporting pieces of the upper and lower horizontal frames, respectively are engaged with the receiving pieces of the upper and lower mounting frames, respectively, and each of the grooves being used for drainage of rainwater.

Further, according to a third aspect of the present invention, there is provided a stone panel mounting apparatus as set forth in the first aspect, wherein the mounting frame-work comprises further at least one intermediate mounting frame having two upward receiving pieces formed as integral parts of the front portion thereof and spaced apart by a predetermined distance in the vertical direction, said intermediate mounting frame being mounted between the upper and lower mounting frames.

Yet further, according to a fourth aspect of the present invention, there is provided a stone panel mounting apparatus as set forth in the third aspect, characterized in that the mounting framework has a plurality of support frame units mounted on the front surface thereof, each of the support frame units having one piece of stone panel fitted thereto.

Still further, according to a fifth aspect of the present invention, there is provided a stone panel mounting apparatus as set forth in the third aspect, characterized in that the intermediate mounting frame has an intermediate, lower horizontal frame mounted on the upper part of the front surface thereof, the intermediate, lower horizontal frame comprising: a rectangular, hollow body, a vertical plate formed as the front part of the body and extending downwardly, a hook-shaped piece having an inverted L-shaped longitudinal section, the hook-shaped piece being formed integrally with the lower portion of the vertical plate so as to project therefrom further forwardly to thereby form a downward groove between the hook-shaped piece and the vertical plate, and an engaging piece formed integrally with the rear portion of the body so as to project downwardly from the lowermost part thereof, the engaging piece being engaged with an upper receiving piece out of two receiving pieces formed integrally with the front portion of the intermediate mounting frame, and the intermediate mounting frame has an intermediate, upper horizontal frame mounted on the lower part of the front surface thereof, the intermediate, upper horizontal frame comprising: a rectangular, hollow body, a vertical frame formed as the front part of the body and extending upwardly, a hook-shaped piece having an L-shaped longitudinal section, the hook-shaped piece being formed integrally with the upper portion of the vertical plate so as to project therefrom further forwardly to thereby form an upward groove between the hook-shaped piece and the vertical plate, and a supporting piece having an inverted L-shaped longitudinal section with the leading end of the L-shape facing downwardly, the supporting piece being located opposite to the hook-shaped piece relative to the vertical plate and formed integrally with the body so as to project rearwardly therefrom, the supporting piece being engaged with a lower receiving piece out of two receiving pieces formed integrally with the front portion of the intermediate mounting frame.

As is apparent from the above-mentioned aspects, the stone panel mounting apparatus according to the present invention is arranged so as to mount stone panels on a building body by mounting a support frame unit on the rear surface of each stone panel and mounting the support frame units on the front surface of the mounting framework, so that the stone panels can be mounted readily on the building body by simple operation.

Stating more concretely, since the stone panels are mounted on the mounting framework by mounting the support frame units fitted to the rear surfaces of the stone panels, respectively, on the mounting framework, the stone panels can be mounted on the building body by mounting the mounting framework on the latter. Therefore, if a plurality of stone panels are mounted on the mounting frame-work, the stone panels can be mounted at once on the building body by attaching the mounting framework on the latter, so that the mounting operation per se becomes very simple.

Further, since the stone panels are mounted on the mounting framework by engaging the support pieces of the support frame units mounted on the rear surfaces of the stone panels, respectively, with the upper and lower receiving pieces, respectively, of the mounting framework, the operation of mounting the stone panels on the mounting framework becomes simple.

Further, since the upper groove formed in the upper frame of each support frame unit is connected with the vertical space formed between the transverse hook-shaped piece of each vertical frame and the notch of each stone panel, rainwater which flows down into the upper groove can be drained from the vertical space so that there is no possibility of rain-water making ingress in between the stone panel and the support frame unit.

The above-mentioned and other objects, aspects and advantages of the present invention will become apparent to those skilled in the art by making reference to the following description and the accompanying drawings in which a preferred embodiment thereof incorporating the principles of the present invention are shown by way of example only.

DETAILED DESCRIPTION OF PREFERRED EMBODIMENT

The present invention will now be described in detail below by way of example only with reference to the accompanying drawings.

Figure 4:
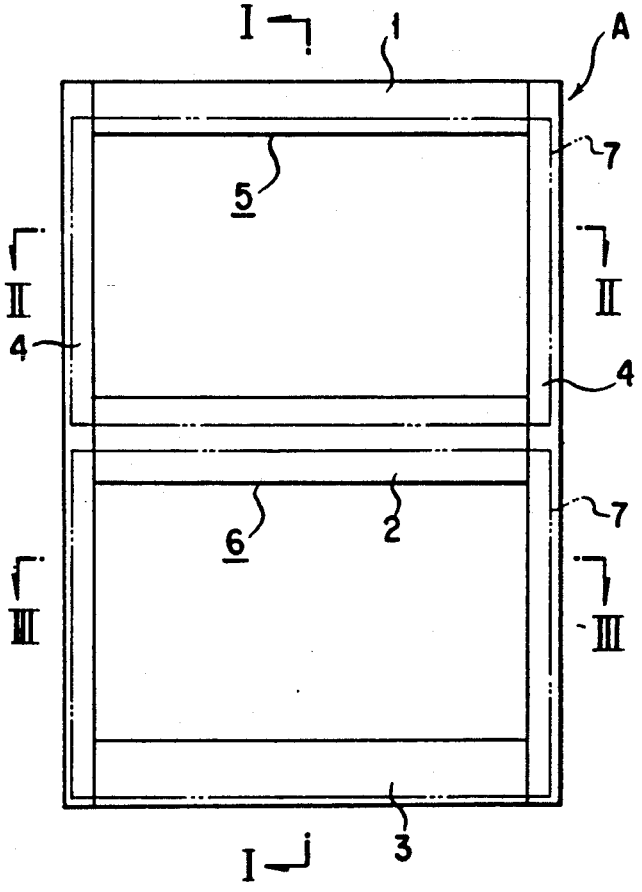
FIG. 4 is a schematic, front view showing one embodiment of the present invention.

As seen from the schematic front view illustrated in FIG. 4, a stone panel mounting framework A is a rectangular member comprising an upper frame portion 5 which is formed by an upper mounting frame 1, an intermediate mounting frame 2 and a left-hand vertical mounting frame 4 and a right-hand vertical frame 4, and a lower frame portion 6 which is formed by the intermediate mounting frame 2, a lower mounting frame 3, and the left-hand and right-hand vertical mounting frames 4, 4. Each of the upper and lower frame portions 5 and 6 has a stone panel 7 fitted thereto.

Figure 1:
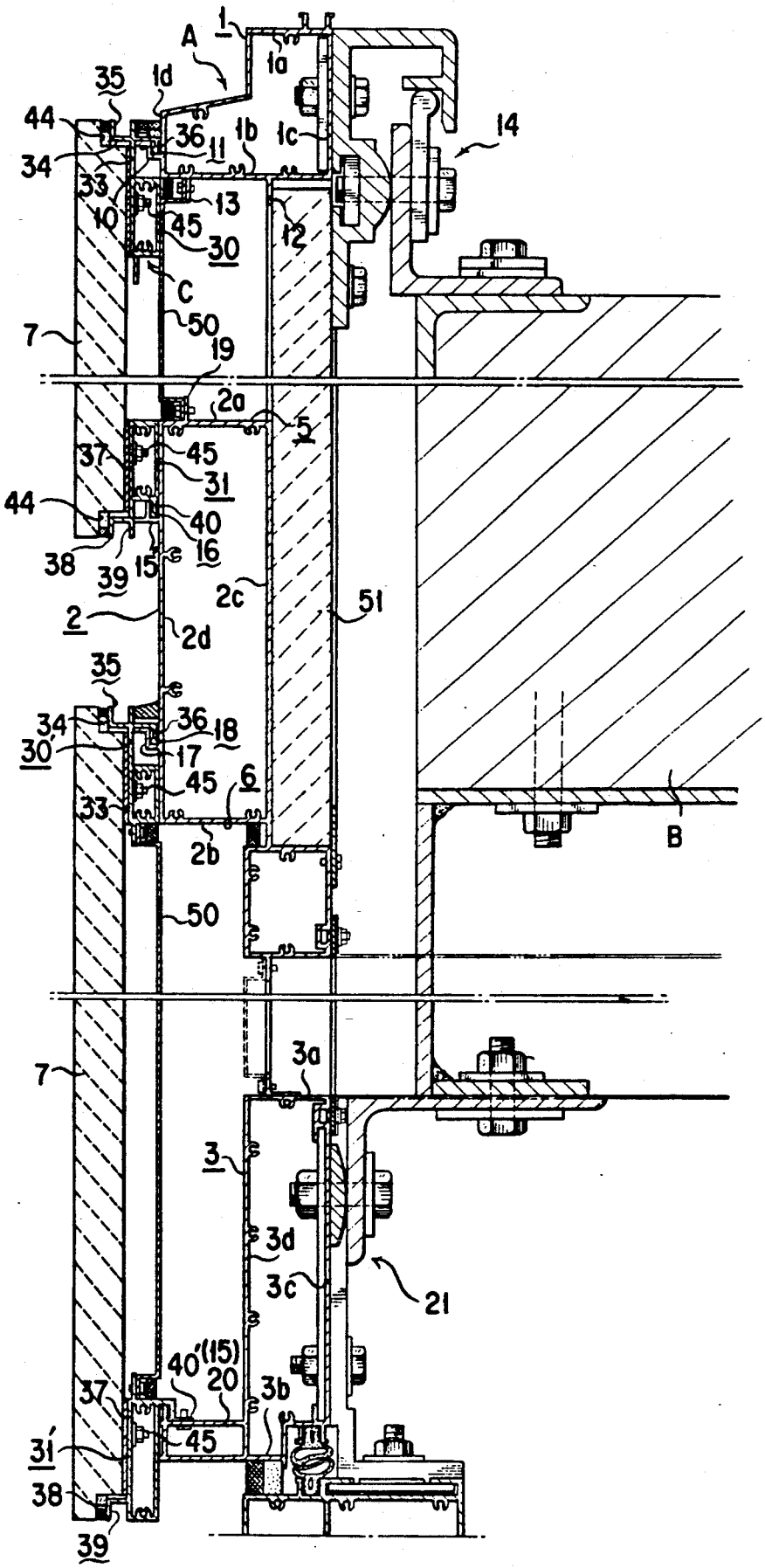
FIGS. 1, 2 and 3 are sectional views taken along lines I—I, II—II and III—III, respectively, in FIG. 4.

As shown in FIG. 1, the above-mentioned upper mounting frame 1 is a long, hollow member having a substantially rectangular sectional shape, which is formed by a step-shaped upper plate 1*a*, a step-shaped lower plate 1*b*, an inner vertical plate 1*c*, and an outer vertical plate 1*d*. The outer vertical plate 1*d* has a crank-shaped receiving piece 10 formed integrally therewith so as to form an upward upper engaging recess 11. The lower plate 1*b* has inner and outer receiving pieces 12 and 13 formed integrally therewith. The upper mounting frame 1 is fixedly secured by means of upper connecting metal fixtures to the building body B.

The above-mentioned intermediate mounting frame 2 is a long, hollow member having a rectangular sectional shape, which is formed by an upper plate 2*a*, a lower plate 2*b*, an inner vertical plate 2*c*, and an outer vertical plate 2*d*. The outer vertical plate 2*d* has a receiving piece 15' formed integrally with the upper part thereof so as to form an upward lower engaging recess 16, and a crank-shaped receiving piece 17 formed integrally with the lower part thereof so as to form an upward upper engaging recess 18. The upper plate 2*a* has an outer receiving piece 19 formed integrally therewith.

The above-mentioned lower mounting frame 3 is a long, hollow member having a rectangular sectional shape, which is formed by an upper plate 3*a*, a lower plate 3*b*, inner vertical plate 3*c*, and an outer vertical plate 3*d*. The outer vertical plate 3*d* has a hollow lower mounting section 20 formed integrally therewith, the upper surface of which serving as a receiving piece 15. The lower mounting frame 3 is fixedly secured to the building body B by means of lower connecting metal fixtures 21.

Figure 2:
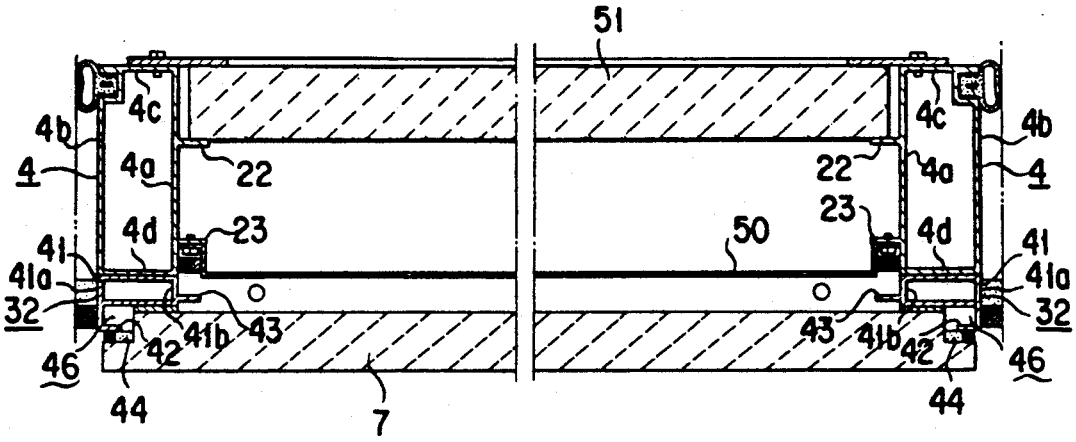
Figure 3:
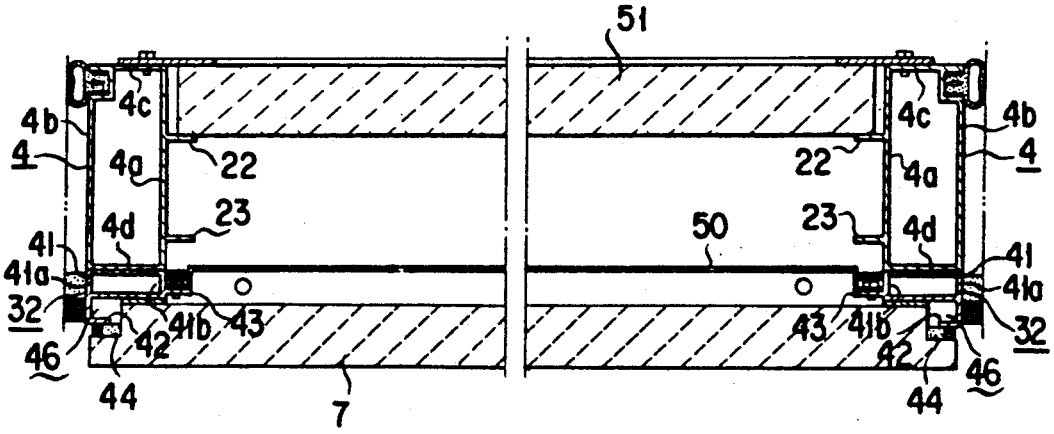

As shown in FIGS. 2 and 3, the above-mentioned vertical mounting frame 4 is a hollow member having a rectangular sectional pipe, which is formed by an inner plate 4*a*, an outer plate 4*b*, an inner vertical plate 4*c*, and an outer vertical plate 4*d*. The inner plate 4*a* has an inner receiving piece 22 and an outer receiving piece 23 formed integrally therewith.

The above-mentioned stone panel 7 is mounted on the front surface of a support frame unit C. The support frame unit C is a rectangular member which is formed by an upper frame 30, a lower frame 31, a left-hand vertical plate 32 and a right-hand vertical plate 32. The upper frame 30 includes a vertical plate 33 whose upper portion has an upward hook-shaped piece 34 formed integrally therewith so as to form an upward groove 35, and a downward hook-shaped supporting piece 36 formed integrally therewith and which is engaged with the upper engaging recess 11.

The above-mentioned lower frame 31 includes a vertical plate 37 whose lower portion has a downward hook-shaped piece 38 formed integrally therewith so as to form a downward groove 39, and a crank-shaped supporting piece 40 formed integrally therewith and which is engaged with the lower engaging member 20.

The above-mentioned vertical plate 32 is comprised of a hollow, rectangular body 41, whose outer plate 41*a* has an inward and lateral hook-shaped piece 42 formed integrally therewith and whose inner plate 41*b* has a projecting piece 43 formed integrally therewith.

The above-mentioned stone panel 7 has a continuously extending notch 44 formed along the outer peripheral edge of the rear portion thereof. The stone panel 7 is mounted on the front surface of the support frame unit C such that the notch 44 faces the upward hook-shaped piece 34, the downward hook-shaped piece 38, and the inward and lateral hook-shaped piece 42. The stone panel 7 is fixedly secured by means of bllts 45 to the vertical plates 33 and 37, respectively, in such a manner that the support frame unit C can not be seen from the front side. Further, a vertical space 46 is formed between the inward and lateral hook-shaped piece 42 of each of the vertical frames 32 and the notch 44 of the stone panel 7. This vertical space 46 is connected with the upward groove 35 so that rainwater may flow down along the upper mounting frame 1 and then along the upper groove 35 into the vertical space 46 from where it is drained so as to prevent rainwater from making ingress into the space defined between the support frame unit C and the stone panel 7.

The inner surface, that is, the indoor side surface of the above-mentioned support frame unit C is fitted with a reinforcing surface material 50 such as, for example, an aluminum plate so as to prevent the support frame unit C from being distorted by the weight of the stone panel 7. Both ends of the reinforcing surface material 50 is fixedly secured by means of screws either to the mounting frame member A or to the support frame unit C.

The above-mentioned mounting framework A has a refractory panel 51 mounted on the inner surface, that is, the indoor side surface thereof.

Whilst, in the above-mentioned embodiment, the mounting framework A is shown as being fitted with two pieces of stone panels 7, it may be fitted with one piece, or three or more pieces of panels 7.

Further, an intermediate, lower horizontal frame 31 mounted on the upper part of the above-mentioned intermediate mounting frame 2 comprises a hollow, rectangular body; a vertical plate 37 formed as the front portion of the body and extending downwardly; a hook-shaped piece 38 having inverted L-shaped vertical section shape, the hook-shaped piece 38 being formed integrally with the lower portion of the vertical plate 37 so as to project therefrom further forwardly to thereby form a downward groove 39 between the hook-shaped piece 38 and the vertical plate 37; and an engaging piece 40 formed integrally with the body so as to project downwardly from the lowermost part of the rear surface thereof and which is engaged with an upward receiving piece 15′ formed integrally with the front portion of the intermediate mounting frame 2.

An intermediate, upper horizontal frame 30′ mounted through the intermediary of a lower receiving piece 17 on the lower part of the intermediate mounting frame 2 is substantially the same in construction and manner of mounting as the upper, horizontal frame 30 mounted on the upper mounting frame 1 which has already been described above, and therefore the description thereof is omitted herein to avoid duplication of explanation.

It is to be understood that the foregoing description is merely illustrative of a preferred embodiment of the present invention, and that the scope of the present invention is not to be limited thereto, but is to be determined by the scope of the appended claims.

What is claimed is:

1. A stone panel mounting apparatus comprising:

a rectangular support frame unit formed by an upper horizontal frame, a lower horizontal frame, and a left-hand vertical frame and a right hand vertical frame, both of which are connected to the upper and lower horizontal frames, respectively;

a stone panel having a continuously extending notch formed along the outer peripheral edge of the rear surface thereof and mounted through the intermediary of the notch on the front surface of said support frame unit; and a rectangular mounting framework formed by an upper mounting frame fixedly secured through the intermediary of upper connecting metal fixtures onto a building body, a lower mounting frame fixedly secured through the intermediary of lower connecting metal fixtures onto the building body, and a left-hand vertical mounting frame and a right-hand vertical mounting frame, both of which are connected to the upper and lower mounting frames, respectively;

and wherein at least one support frame unit having said stone panel fitted thereto is mounted on the outdoor side front surface of said mounting framework.

2. A stone panel mounting apparatus as claimed in claim 1, wherein the upper horizontal frame of said support frame unit comprises a rectangular, hollow body, a vertical plate formed as the front part of the body and extending upwardly, a hook-shaped piece having an L-shaped longitudinal section, the hook-shaped piece being formed integrally with the upper portion of the vertical plate so as to project therefrom further forwardly to thereby form an upward groove between the hook-shaped piece and the vertical plate, and a supporting piece having an inverted L-shaped longitudinal section with the leading end of the L shape facing downwardly, the supporting piece being located opposite to the hook-shaped piece relative to said vertical plate and formed integrally with the body so as to project rearwardly therefrom;

the lower horizontal frame of said support frame unit comprises a rectangular, hollow body a vertical plate formed as the front part of the body and extending downwardly, a hook-shaped piece having an inverted L-shaped longitudinal section, the hook-shaped piece being formed integrally with the lower portion of the vertical plate so as to project therefrom further forwardly to thereby form a downward groove between the hook-shaped piece and the vertical plate, and a supporting piece having a crank-shaped longitudinal section with the leading end of the crank-shape extending horizontally, the supporting piece being located rearwardly of the body and formed integrally with the body so as to project rearwardly therefrom; and each of the left-hand and right-hand vertical frames of said support frame unit comprises a rectangular, hollow body, and an inward and lateral hook-shaped piece having an L-shaped or inverted L-shaped cross-section, the hook-shaped piece being formed integrally with the body so as project forwardly from the left-hand and or the right-hand and thereof to thereby form a transverse groove between the hook-shaped piece and the front portion of the body;

wherein said supporting pieces of said upper and lower horizontal frames are respectively engaged with receiving pieces integrally formed on respective outer partical plates of the upper and the lower mounting frames of said rectangular mounting framework, respectively, and each of said grooves being used for drainage of rainwater.

3. A stone panel mounting apparatus as claimed in claim 1, wherein said mounting framework comprises further at least one intermediate mounting frame having two upward receiving pieces formed as integral parts of the front portion thereof and spaced apart by a predetermined distance in the vertical direction, said intermediate mounting frame being mounted between said upper and lower mounting frames.

4. A stone panel mounting apparatus as claimed in claim 3, characterized in that said mounting framework has a plurality of support frame units mounted on the front surface thereof, each of the support frame units having one piece of stone panel fitted thereto.

5. A stone panel mounting apparatus as claimed in claim 3, characterized in that said intermediate mounting frame has an intermediate, lower horizontal frame mounted on the upper part of the front surface thereof, the intermediate, lower horizontal frame comprising: a rectangular, hollow body, a vertical plate formed as the front part of the body and extending downwardly, a hook-shaped piece having an inverted-L shaped longitudinal section, the hook-shaped piece being formed integrally with the lower portion of the vertical plate so as to project therefrom further forwardly to thereby form a downward groove between the hook-shaped piece and the vertical plate, and an engaging piece formed integrally with the rear portion of said body so as to project downwardly from the lowermost part thereof, the engaging piece being engaged with an upper receiving piece out of two receiving pieces formed integrally with the front portion of said intermediate mounting frame, and said intermediate mounting frame has an intermediate, upper horizontal frame mounted on the lower part of the front surface thereof, the intermediate, upper horizontal frame comprising: a rectangular, hollow body, a vertical plate formed as the front part of the body and extending upwardly, a hook-shaped piece having an L-shaped longitudinal section, the hook-shaped piece being formed integrally with the upper portion of the vertical plate so as to project therefrom further forwardly to thereby form an upward groove between the hook-shaped piece and the vertical plate, and a supporting piece having an inverted L-shaped longitudinal section with the leading end of the L-shape facing downwardly, the supporting piece being located opposite to the hook-shaped piece relative to the vertical plate and formed integrally with the body so as to project rearwardly therefrom, the supporting piece being engaged with a lower receiving piece out of two receiving pieces formed integrally with the front portion of said intermediate mounting frame.

* * * * *